US005322249A

United States Patent [19]

You

[11] Patent Number: 5,322,249

[45] Date of Patent: * Jun. 21, 1994

[54] METHOD OF MAKING GAME RACKET FRAME OF PLASTIC COMPOUND MATERIAL

[76] Inventor: Chin-San You, No. 3, Lane 1029, Feng-Shyn Road, Feng Yuan City, Taichung Hsien, Taiwan

[ * ] Notice: The portion of the term of this patent subsequent to Mar. 30, 2010 has been disclaimed.

[21] Appl. No.: 913,321

[22] Filed: Jul. 15, 1992

[51] Int. Cl.[5] ..... B29C 43/02

[52] U.S. Cl. ..... 264/516; 264/258; 264/314; 156/156; 156/187; 156/188; 156/194; 156/245; 273/73 F

[58] Field of Search ..... 264/512, 516, 510, 257, 264/258, 314; 156/156, 173, 187, 188, 194, 245; 273/73 F

[56] References Cited

U.S. PATENT DOCUMENTS

| | | | |
|---|---|---|---|
| 3,256,125 | 6/1966 | Tyler | 264/516 |
| 3,493,240 | 2/1970 | Jenks | 264/516 |
| 3,755,037 | 8/1973 | Erwin et al. | 264/314 |
| 3,949,988 | 4/1976 | Staufer | 264/314 |
| 4,144,632 | 3/1979 | Stroupe | 264/257 |
| 4,183,776 | 1/1980 | Staub et al. | 264/314 |
| 5,047,263 | 9/1991 | Glemet | 427/203 |
| 5,176,868 | 1/1993 | Davis | 264/258 |
| 5,198,058 | 3/1993 | You | 156/173 |

FOREIGN PATENT DOCUMENTS

| | | | |
|---|---|---|---|
| 57-098320 | 6/1982 | Japan | 264/516 |
| 63-092442 | 4/1988 | Japan | 264/512 |

*Primary Examiner*—Catherine Timm
*Attorney, Agent, or Firm*—Browdy and Neimark

[57] ABSTRACT

A method of making game racket frame of plastic compound material includes a tubular body, which is formed by a bendable inner tube wrapped orderly and windingly with the cured thermoplastic plastic thin films and the long fiber fabric sheets made up of a plurality of long fiber bundles. The tubular body is placed in a mold cavity of a molding tool, which is subjected to a heat corresponding to the melting point of the thermoplastic plastic thin film. A gas with a first predetermined pressure is introduced into the tubular body so as to force the molten thermoplastic plastic thin film to diffuse uniformly into the interstices of the fiber bundles. Another gas having a second predetermined pressure is introduced into the tubular body to force the outer shell of tubular body to attach intimately to the wall of mold cavity of the molding tool, which is then cooled to permit the removal of the racket frame made therein. The method produces a recyclable racket frame and no waste causing environmental pollution.

7 Claims, 3 Drawing Sheets

METHOD OF MAKING GAME RACKET FRAME OF PLASTIC COMPOUND MATERIAL

BACKGROUND OF THE INVENTION

The present invention relates to a method of making a game racket frame, and more particularly to a method of making a game racket frame of plastic compound material, which is made up of a thermoplastic plastic as a base material and a long fiber material as a reinforcing material.

In order to make a lightweight and strong ball racket frame of plastic compound material, the outer shell of such racket frame is generally made from a plurality of stacked and intertwined long fiber fabric sheets preimpregnated in epoxy resin. However, such method as described above is defective in that the cured epoxy resin can not be recycled easily, and that the viscosity of the epoxy resin used to preimpregnate the fabric sheets must be reduced by dilution by means of a volatile diluent, which is toxic and hazardous to the health of workers. In addition, the releasing paper used in wrapping the long fiber bundles becomes a cost factor of making a ball racket frame as well as a source of waste responsible for environmental pollution.

SUMMARY OF THE INVENTION

It is, therefore, the primary objective of the present invention to provide a pollution-free method of making a game racket frame of plastic compound material.

It is another objective of the present invention to provide a waste-free method of making a game racket frame of plastic compound material.

In keeping with the principles of the present invention, the foregoing objectives of the present invention are accomplished by a method of making a game racket frame of plastic compound material, which is made up of a thermoplastic plastic as a base material and a long fiber material as a reinforcing material. The method includes the steps of: (a) using a bendable inner tube made of high temperature resistant elastic or elastomeric material capable of being inflated; (b) wrapping windingly the bendable inner tube with at least a layer of the cured thermoplastic plastic film and at least a layer of long fiber fabric made up of a plurality of long fiber bundles so as to obtain a bendable tubular body; (c) placing the bendable tubular body in mold cavity of a molding tool; (d) heating the molding tool at a temperature corresponding to the melting point of the thermoplastic plastic film and injecting into the bendable tubular body a gas having a first predetermined pressure, so as to cause the molten thermoplastic plastic film to permeate the interstices of long fiber bundles making up the long fiber fabric; (e) upon having waited for a predetermined period of time, injecting into the tubular body a gas having a second predetermined pressure which is greater than the first predetermined pressure, so as to inflate the inner tube and force the outer shell of the tubular body to attach intimately to the wall of the mold cavity of the molding tool; and (f) cooling the molding tool to permit the curing or solidification of the molten thermoplastic plastic in the interstices of the long fiber bundles to take place, so that the tubular body takes the form of a game racket frame consistent with the shape of the mold cavity of the molding tool.

The method of the present invention described above does not produce a waste such as releasing paper, which is produced in the prior art method and is responsible for environmental pollution. In addition, the method of the present invention does not rely on a hazardous volatile diluent to dilute the viscosity of the base material. Furthermore, the method of the present method uses the thermoplastic plastic in place of epoxy resin which is relatively difficult to be recycled.

DETAILED DESCRIPTION OF THE PREFERRED EMBODIMENTS

Figure 1:
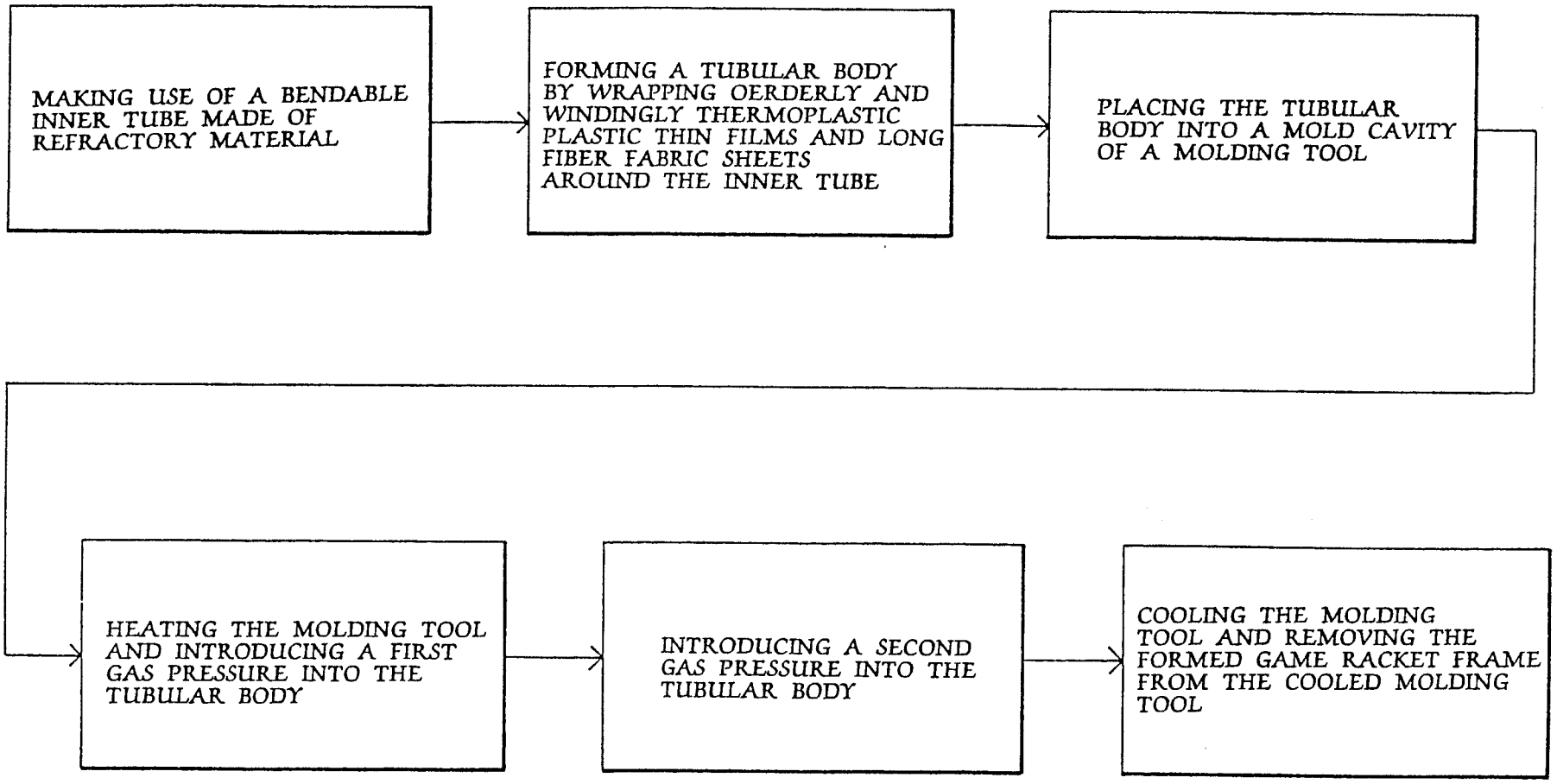
FIG. 1 shows a process flow of a first preferred embodiment of the present invention.
Figure 2:
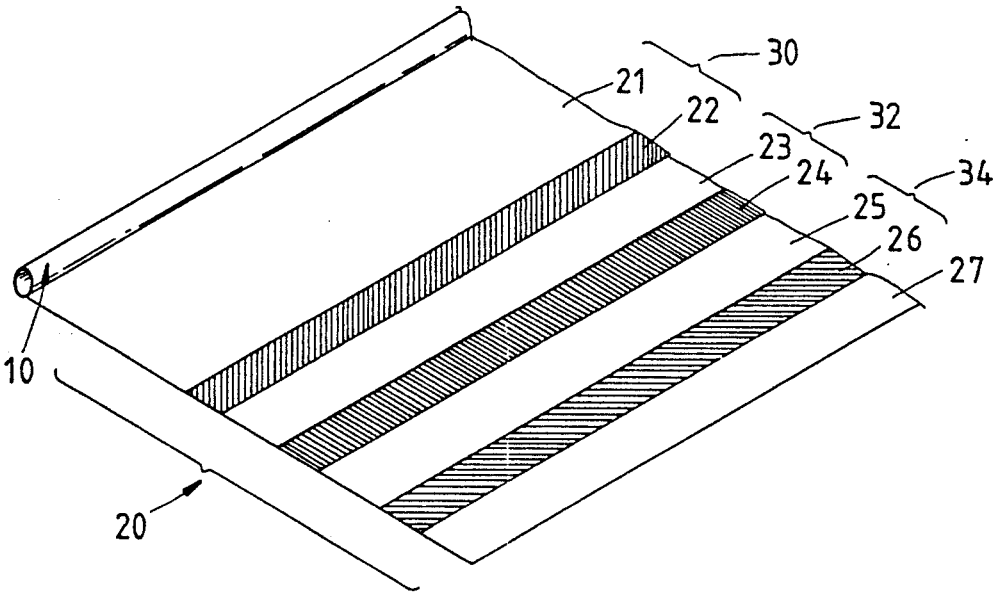
FIG. 2 shows a three-dimensional view of a tubular body of the first preferred embodiment of the present invention.
Figure 3:
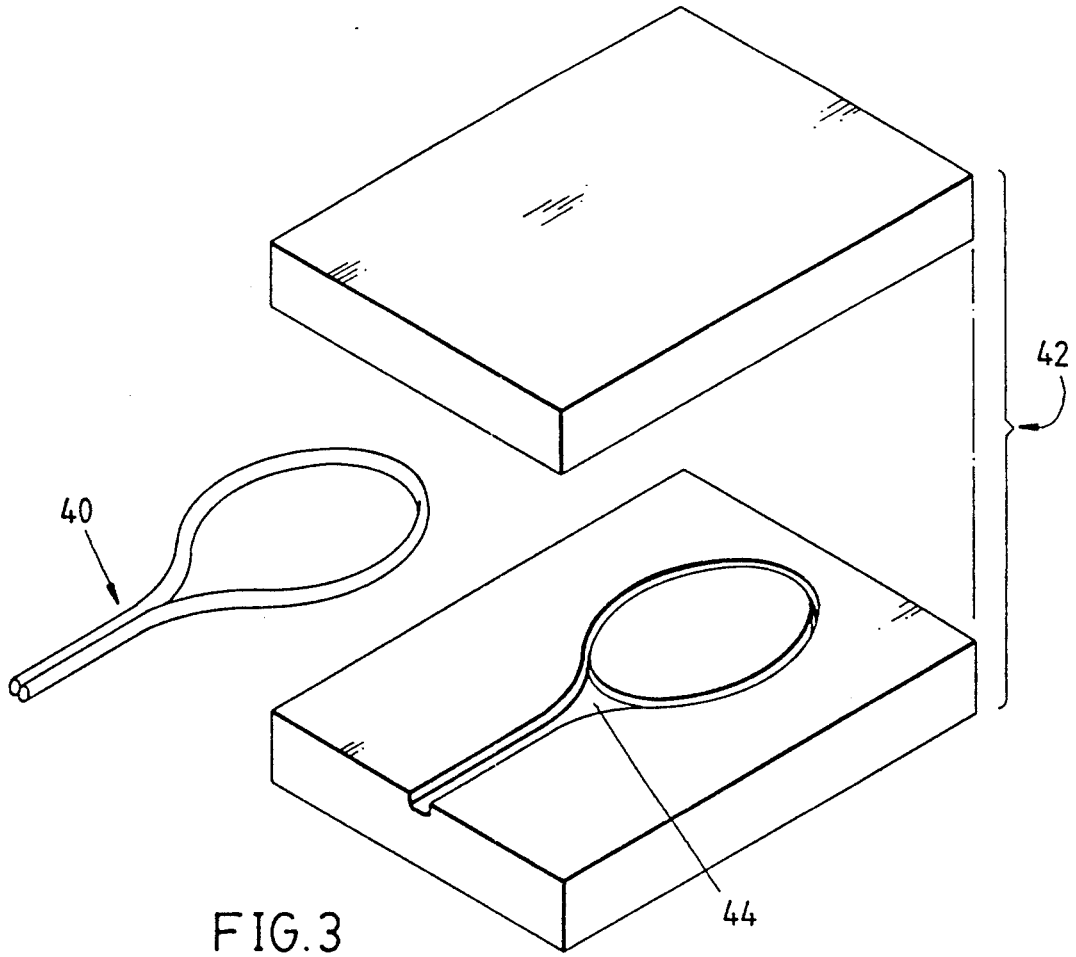
FIG. 3 shows a schematic view of the tubular body which is placed in the mold cavity of a molding tool according to the present invention.
Figure 4:
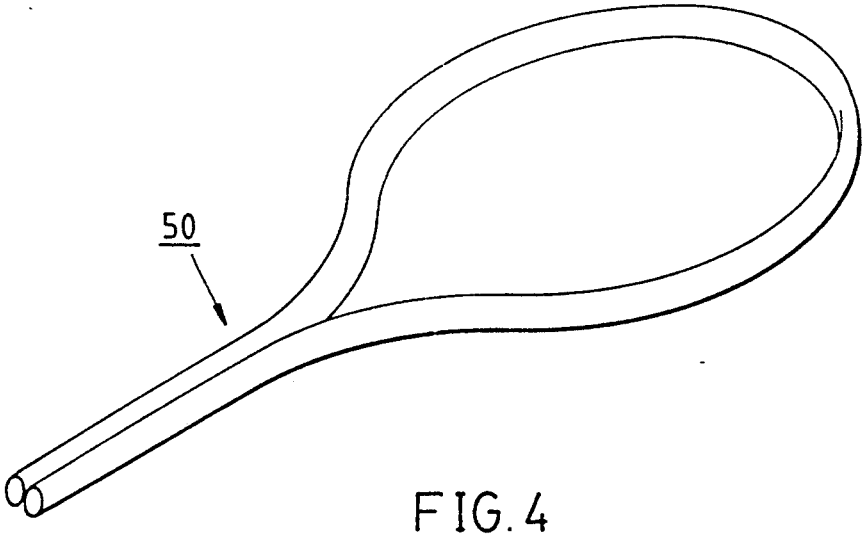
FIG. 4 shows a three-dimensional view of a game racket which is made according to the first preferred embodiment of the present invention.

Referring to all drawings provided herewith, a first preferred embodiment of the present invention is shown to comprise an inner tube 10 made of a high temperature resistant elastomeric material such as a silicone rubber. The inner tube 10 is wrapped with a laminated shell 20, which is composed of the orderly stacked four layers of thin films 21, 23, 25 and 27 of nylon 6 (a polyamide), and of three layers of carbon fiber fabric sheets 22, 24 and 26 having respectively the fiber orientation of +30, 0, and −30.

Each of the carbon fiber fabric sheets 22, 24 and 26 is made up of a plurality of long carbon fiber bundles arranged in a specific orientation. The carbon fiber fabric sheets 22, 24 and 26 are separately adhered to the thin films 21, 23 and 25. In other words, the first carbon fiber fabric sheet 22 is attached to the first thin film 21 to form a first plastic compound layer 30; the second carbon fiber fabric sheet 24 is attached to the second thin film 23 to form a second plastic compound layer 32; the third carbon fiber fabric sheet 26 is attached to the third thin film 25 to form a third plastic compound layer 34. The first plastic compound layer 30, the second plastic compound layer 32 and the third plastic compound layer 34 are orderly wrapped windingly around the inner tube 10, which is finally wrapped around by the fourth thin film 27 to form a tubular body 40.

The tubular body 40 is then placed in a mold cavity 44 of a molding tool 42. The mold cavity 44 is of a shape of a game racket frame intended to be made. The molding tool 42 containing the tubular body is heated to a temperature of 220 degrees in Celsius. In the meantime, a gas with a first pressure of 1-3 kg/mm is introduced into the tubular body 40, so as to force the molten thin films 21, 23, 25 and 27 to permeate uniformly into the interstices of the long fiber bundles of the carbon fiber fabric sheets 22, 24 and 26. Such permeating process is allowed to last for a period of about 5 minutes before a gas having a second pressure of 5–10 kg/mm is introduced into the tubular body 40 so as to ensure that the molten thermoplastic plastic material is thoroughly diffused into the interstices of the long fiber bundles. This process is allowed to last for a period of about 10 minutes before a gas having a third pressure of 10–15 kg/mm is introduced into the tubular body 40, so as to force the carbon fiber fabric sheets 22, 24 and 26, along with the molten nylon material remaining in the interstices of the fiber bundles, to attach intimately to the wall of the mold cavity 44.

The molding tool 42 is allowed to cool to permit the curing process of the molten nylon material remaining in the interstices of the fiber bundles to take place. As a result, the tubular body 40 takes the form of a game racket frame 50 in agreement with the shape of the mold cavity 44.

Figure 5:
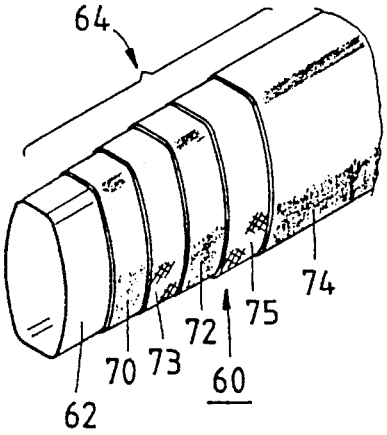
FIG. 5 shows a three-dimensional sectional view of a portion of the tubular body which is made according to a second preferred embodiment of the present invention.
Figure 6:
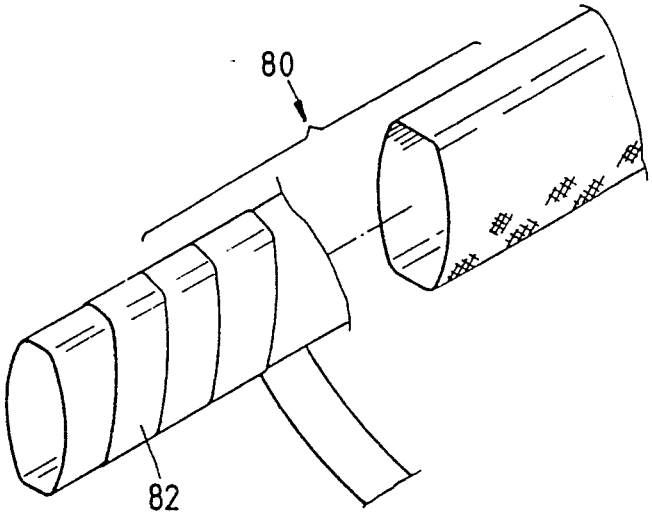
FIG. 6 shows a three-dimensional schematic view of a thermoplastic plastic film made of orderly intertwined nylon ribbons according to a third preferred embodiment of the present invention.
Figure 7:
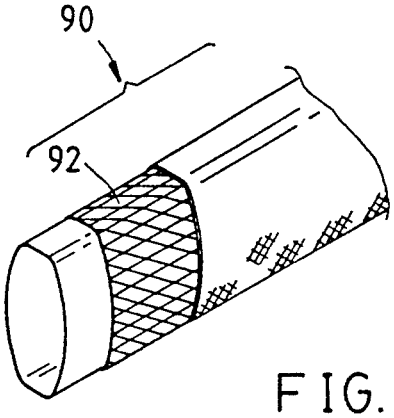
FIG. 7 shows a three-dimensional schematic view of a thermoplastic plastic film having a netlike surface according to a fourth preferred embodiment of the present invention.

Now referring to FIGS. 5, 6 and 7, a tubular body 60 of a second preferred embodiment of the present invention is shown comprising a bendable inner tube 62 covered by an outer shell 64, which is composed of orderly arranged first, second and third thin films 70, 72 and 74 of nylon 6, and of first and second fiber fabric sheets 73 and 75 made up of a plurality of carbon fiber bundles, as shown in FIG. 5. In addition, a third preferred embodiment of the present invention is shown to comprise an outer shell 80 formed by nylon thin films 82, which have a predetermined width and are used to wrap windingly around the outer shell 80, as shown in FIG. 6. A fourth preferred embodiment of the present invention has an outer shell 90 formed by nylon thin films 92, which are of netted construction and are used to wrap windingly around the outer shell 90, as shown in FIG. 7.

On the basis of detailed descriptions of the preferred embodiments of the present invention disclosed above, it is apparent that the game racket frame 50 so made is provided with qualities of lightweight and excellent strength, and that the thermoplastic plastic material making up the game racket frame 50 can be easily recovered by subjecting the racket frame 50 to a heat corresponding to the melting point of the thermoplastic plastic material which is used as a base material of the racket frame 50, and further that the present invention is not hazardous to the health of workers in view of the fact that both impregnation and toxic volatile diluent are not used to combine the base material and the reinforcing material in the present invention, and still further that the present invention makes use of nylon thin films as base materials to bind the fiber bundles so as to form fiber fabric sheets, thereby resulting in a reduction in the cost of making a game racket frame, and thereby producing no waste that is a source of environmental pollution.

What is claimed is:

1. A method of making a game racket frame of plastic compound material, in which said plastic compound material is composed of a thermoplastic plastic as a base material and of a fiber material as a reinforcing material, said method comprising the steps of:

(a) making use of a bendable inner tube of heat resistant and inflatable material;

(b) wrapping at least a layer of thermoplastic plastic thin films and at least a layer of long fiber fabric sheets made of a plurality of fiber bundles orderly and windingly around said bendable inner tube to form a tubular body;

(c) placing said tubular body in a mold cavity of a molding tool, with said mold cavity having a shape of said game racket frame;

(d) heating said molding tool to a melting point of said thermoplastic plastic material, and introducing gas into said tubular body to pressurize said tubular body to a first predetermined pressure so as to cause said thermoplastic plastic material to melt and to permeate uniformly into interstices of said fiber bundles of said fiber fabric sheets;

(e) after said step (d) introducing additional gas into said tubular body to pressurize said tubular body to a second predetermined pressure greater than said first predetermined pressure so as to force an outer shell of said tubular body to attach intimately to the wall of said mold cavity of said molding tool; and (f) cooling said molding tool to allow said thermoplastic plastic material, which has permeated into said interstices of said fiber bundles, to solidify so that said tubular body takes the form of said game racket frame in agreement with said shape of said mold cavity.

2. The method of claim 1 further comprising a step (d') between said step (d) and said step (e), wherein step (d') comprises:

(d') introducing additional gas into said tubular body to pressurize said tubular body to a third predetermined pressure, which is between said first predetermined pressure and said second predetermined pressure in magnitude, so as to force said thermoplastic plastic material to diffuse thoroughly and uniformly into said interstices of said fiber bundles.

3. The method of claim 1 wherein said thermoplastic plastic thin films are sheet-like; wherein said long fiber fabric sheets are composed of said fiber bundles arranged in a predetermined orientation to adhere to said thermoplastic plastic thin films; and wherein said long fiber fabric sheets are orderly wrapped around said inner tube.

4. The method of claim 1 wherein said thermoplastic plastic thin films are of ribbonlike strips.

5. The method of claim 1 wherein said thermoplastic plastic thin films have a netted surface.

6. The method of claim 1 wherein said tubular body has an outermost layer of a thermoplastic plastic thin film.

7. The method of claim 1 wherein said thermoplastic plastic thin films are made from a polyamide.

* * * * *